US009820577B2

(12) United States Patent
Choi

(10) Patent No.: US 9,820,577 B2
(45) Date of Patent: Nov. 21, 2017

(54) FOLDABLE CHAIR WITH STABILIZING MECHANISM

(71) Applicant: Campvalley (Xiamen) Co. Ltd., Xiamen, Fujian Province (CN)

(72) Inventor: Kwan Jun Choi, Xiamen (CN)

(73) Assignee: Campvalley (Xiamen) Co., Ltd., Xiamen (CN)

( * ) Notice: Subject to any disclaimer, the term of this patent is extended or adjusted under 35 U.S.C. 154(b) by 0 days.

(21) Appl. No.: 15/294,282

(22) Filed: Oct. 14, 2016

(65) Prior Publication Data

US 2017/0105527 A1 Apr. 20, 2017

(30) Foreign Application Priority Data

Oct. 14, 2015 (CN) ..... 201520791568.X

(51) Int. Cl.

| | |
|---|---|
| ***A47C 4/24*** | (2006.01) |
| ***A47C 4/14*** | (2006.01) |
| ***A47C 4/38*** | (2006.01) |
| ***A47C 4/48*** | (2006.01) |

(52) U.S. Cl.

CPC ..... *A47C 4/24* (2013.01); *A47C 4/14* (2013.01); *A47C 4/38* (2013.01); *A47C 4/48* (2013.01)

(58) Field of Classification Search

CPC .... A47C 4/48; A47C 4/14; A47C 4/00; A47C 4/24; A47C 4/38; A47B 91/005

USPC ..... 297/48, 24, 25, 463.1, 16.1, 16.2

See application file for complete search history.

(56) References Cited

U.S. PATENT DOCUMENTS 2,073,155 A * 3/1937 Ivey ..... D06F 95/002 248/150
3,112,953 A * 12/1963 Raver ..... A47C 4/40 297/18
5,707,104 A * 1/1998 Perego ..... A47D 1/002 297/16.1
6,824,207 B1 * 11/2004 Lin ..... A47C 4/00 297/16.1

FOREIGN PATENT DOCUMENTS

CN 201375237 Y 1/2010

* cited by examiner

*Primary Examiner* — Milton Nelson, Jr.
(74) *Attorney, Agent, or Firm* — Morgan, Lewis & Bockius LLP

(57) ABSTRACT

A foldable chair includes front and rear legs, a seat frame, and a stabilizing mechanism. The front and rear legs are crossingly and pivotally connected to each other. The seat frame is supported by the front and rear legs and tilted when the foldable chair is unfolded. The stabilizing mechanism restrains the front and rear legs from moving relative to each other when the foldable chair is unfolded or in use, and prevents an undesired or inadvertent folding of the foldable chair. The stabilizing mechanism includes a positioner and a fastening device. The positioner is connected to the front and rear legs, and has a length adjustable to facilitate folding and unfolding of the foldable chair. The fastening device is disposed at the positioner, and configured to prevent the positioner from inadvertently adjusting its length when the foldable chair is unfolded.

19 Claims, 3 Drawing Sheets

FOLDABLE CHAIR WITH STABILIZING MECHANISM

CROSS-REFERENCE TO RELATED APPLICATION

The present application claims priority of Chinese Patent Application Number 201520791568.X filed Oct. 14, 2015, the entire contents of which are incorporated herein for all purposes by this reference.

FIELD OF THE INVENTION

The present invention generally relates to a foldable chair, and more particularly, to a foldable chair with a stabilizing mechanism.

BACKGROUND

Foldable chairs are popular. When not in use, they can be folded to reduce their size, making the transportation of the chairs convenient and cost effective.

Existing foldable chairs are made of a chair frame and a flexible chair cloth. An example of existing foldable chairs is disclosed in Chinese Patent Application Number 200920137393.5, the entire contents of which are incorporated herein for all purposes by this reference. The chair disclosed in CN 200920137393.5 includes a seat frame and U-shaped front and rear legs supporting the seat frame. The U-shaped front and rear legs are slidably coupled to each other by the sliding sleeves hinged on the bars of the U-shaped front legs. The bars of the U-shaped rear leg pass through sliding sleeves. Stoppers are provided on the upper portions of the two bars of the rear leg to prevent the sliding sleeves from moving upward along the bars of the rear leg. The chair is unstable and can be inadvertently folded. For example, if a user lies back, e.g., pushing the seat frame backward, the front leg may be off the ground such that the sliding sleeves moves downward along the bars of the rear leg, resulting in inadvertent and undesired folding of the chair. In addition, the design of this chair is relatively complex.

Given the current state of the art, there remains a need for a foldable chair that addresses the abovementioned issues.

The information disclosed in this Background section is provided for an understanding of the general background of the invention and is not an acknowledgement or suggestion that this information forms part of the prior art already known to a person skilled in the art.

SUMMARY

Various embodiments of the present invention provide a foldable chair with improved stability disclosed below.

In some embodiments, the present invention provides a foldable chair, including front and rear legs, a seat frame, and a stabilizing mechanism. The front and rear legs are crossingly and pivotally connected to each other. The seat frame is supported by the front and rear legs and tilted when the foldable chair is unfolded. The stabilizing mechanism restrains the front and rear legs from moving relative to each other when the foldable chair is unfolded or in use, thereby preventing undesired or inadvertent folding of the foldable chair. The stabilizing mechanism includes a positioner and a fastening device. The positioner is connected to the front and rear legs, and has a length adjustable to facilitate folding and unfolding of the foldable chair. The fastening device is disposed at the positioner, and configured to prevent the positioner from inadvertently adjusting its length when the foldable chair is unfolded.

In some embodiments, the positioner includes first and second segments slidably coupled to each other. The first segment has first and second ends, with the first end connected to the front leg. The second segment has first and second ends, with the second end connected to the rear leg. The fastening device is disposed at the first or second segment, and configured to restrain the first and second segments from moving relative to each other, thereby stabilizing the foldable chair when the foldable chair is unfolded. In an embodiment, one or more of the first and second segments of the positioner are tubular bars. In an embodiment, at least a portion of the second segment of the positioner is slidably inserted into the first segment of the positioner.

In one embodiment, each of the first and second segments of the positioner is formed with an aperture. The fastening device includes a slider, a push-button, an elastic member and a pin. The slider is disposed at the first segment of the positioner, and includes an aperture. The push-button includes first and second ends. The elastic member connects the first end of the push-button with the slider. The pin includes first and second ends, with the first end connected to the second end of the push-button, and the second end configured to be insertable into the apertures of the slider, the first segment and the second segment. The pin, when inserted into the apertures of the slider, the first segment and the second segment, restrains the first segment and the second segment from moving relative to each other.

In an embodiment, the slider includes a receiving chamber. The aperture of the slider is formed at a wall of the receiving chamber. The push-button and the elastic member are disposed in the receiving chamber of the slider. In an embodiment, the slider is fixedly coupled to the second end of the first segment or sleeved onto the second end of the first segment, and is slidable with respect to the second segment. In an embodiment, the elastic member includes a spring. In an embodiment, the pin has a length longer than a free length of the elastic member. In an embodiment, the aperture of the first segment is formed adjacent the second end of the first segment, and/or the aperture of the second segment is formed adjacent the second end of the second segment.

In one embodiment, each of the first and second segments is formed with an aperture, and the fastening device includes a pin configured to be insertable into the apertures of the first segment and the second segment. The pin when inserted into the apertures of the first segment and the second segment restrains the first segment and the second segment from moving relative to each other.

In an embodiment, the seat frame is of a round or circular shape.

In one embodiment, the front leg is of a U-shape including two supporting segments and a lateral segment in between. The rear leg is of a U-shape including two supporting segments and a lateral segment in between. Corresponding supporting segments of the U-shape front and rear legs are scissor-crossingly and pivotally connected to each other. The first end of the first segment of the positioner is connected to the lateral segment of the front leg. The second end of the second segment of the positioner is connected to the lateral segment of the rear leg.

In an embodiment, each open end of the U-shaped front leg is pivotally connected to the seat frame. In an embodiment, the foldable chair further includes two links, each having one end pivotally connected to the seat frame and the other end pivotally connected to an open end of the U-shaped rear leg.

The systems and methods of the present invention have other features and advantages that will be apparent from or are set forth in more detail in the accompanying drawings, which are incorporated herein, and the following Detailed Description, which together serve to explain certain principles of the present invention.

BRIEF DESCRIPTION OF THE DRAWINGS

The accompanying drawings, which are incorporated into and constitute a part of this specification, illustrate one or more embodiments of the present application and, together with the detailed description, serve to explain the principles and implementations of the application.

DETAILED DESCRIPTION

Reference will now be made in detail to implementations of the present application as illustrated in the accompanying drawings. The same reference indicators will be used throughout the drawings and the following detailed description to refer to the same or like parts. Those of ordinary skill in the art will realize that the following detailed description of the present application is illustrative only and is not intended to be in any way limiting. Other embodiments of the present application will readily suggest themselves to such skilled persons having benefit of this disclosure.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of this disclosure can be made without departing from its spirit and scope, as will be apparent to those skilled in the art. The specific embodiments described herein are offered by way of example only, and the disclosure is to be limited only by the terms of the appended claims, along with the full scope of equivalents to which such claims are entitled.

Figure 1:
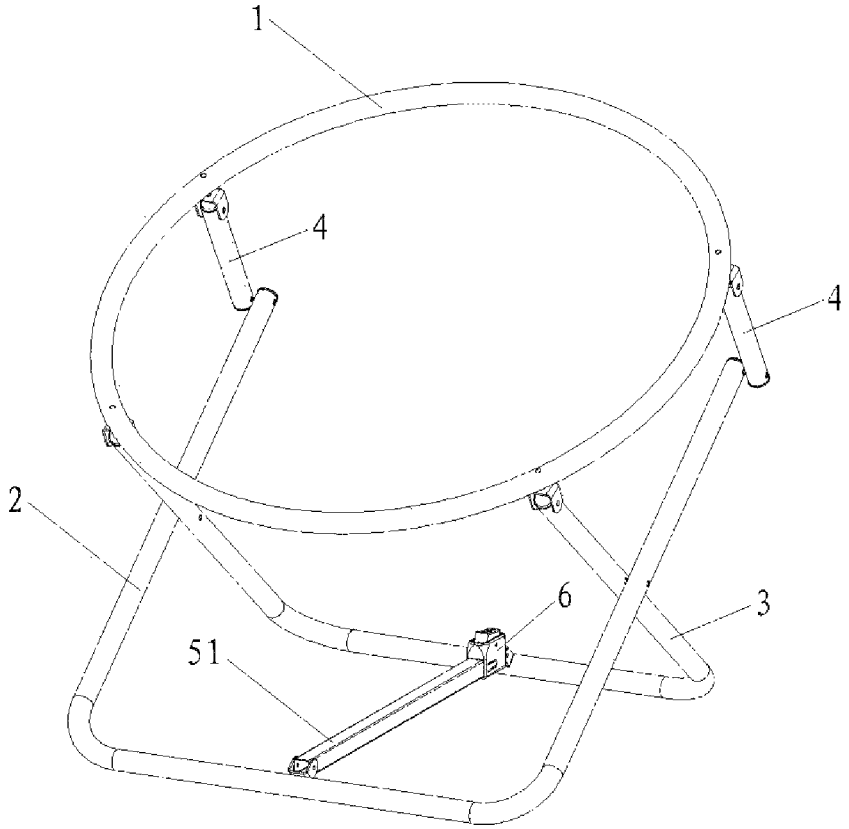
FIG. 1 is a schematic view illustrating a foldable chair in an unfolded state in accordance with some embodiments of the present invention.
Figure 2:
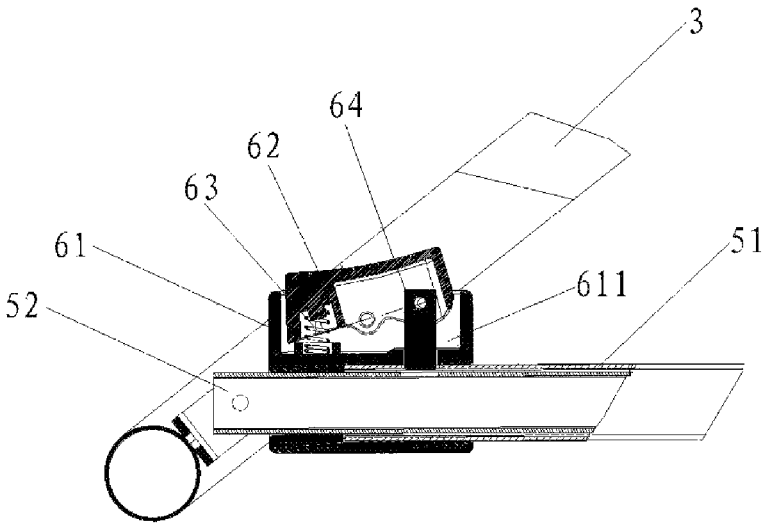
FIG. 2 is a schematic view illustrating a positioner having a fastening device in accordance with some embodiments of the present invention.
Figure 3:
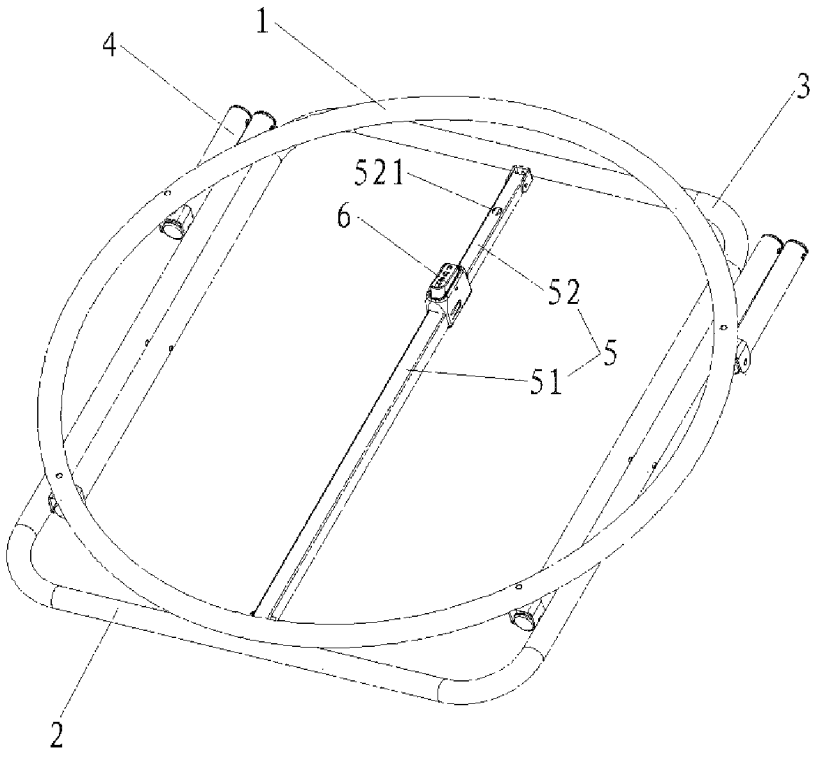
FIG. 3 is a schematic view illustrating a foldable chair in a folded state in accordance with some embodiments of the present invention.

Referring to FIGS. 1-3, there is depicted a foldable chair in unfolded and folded states, respectively, in accordance with some embodiments of the present invention. Generally, a foldable chair includes seat frame 1, front leg 2, rear leg 3, and a stabilizing mechanism. By way of illustration, FIGS. 1-3 show the stabilizing mechanism including positioner 5 and fastening device 6. Positioner 5 is connected to the front and rear legs, and having a length adjustable to facilitate folding and unfolding of the foldable chair. Fastening device 6 is disposed at the positioner, and configured to prevent the positioner from inadvertently adjusting its length when the foldable chair is unfolded. As such, the relative movement of the front and rear legs is restrained, and thus any undesired or inadvertent folding of the foldable chair is prevented by the stabilizing mechanism when the foldable chair is unfolded or in use. With the stabilizing mechanism in place, the foldable chair is more stable and safer to use.

The foldable chair is configured such that when it is unfolded, seat frame 1 is supported by the front and rear legs and tilted (e.g., having an inclination angle with respect to the ground). In some embodiments, seat frame 1 is of a round or circular shape, e.g., made of a tube such as a tubular bar. It should be understood that the term "circular" as used herein does not necessarily mean a perfect circle. In some embodiments, front leg 2 and rear leg 3 are crossingly and pivotally connected to each other. In an embodiment, each of front leg 2 and rear leg 3 is of a U-shape including two supporting segments and a lateral segment in between. Corresponding supporting segments of the U-shape front and rear legs are scissor-crossingly and pivotally connected to each other, as illustrated in, for example, FIG. 1.

Each of the U-shaped front and rear legs has two open ends. In an embodiment, each open end of the U-shaped front and/or rear legs is pivotally connected to the seat frame. In an embodiment, the foldable chair further includes two links 4 for connecting the seat frame with the U-shaped rear leg. As illustrated in FIG. 1, each link 4 has one end pivotally connected to the seat frame and the other end pivotally connected to an open end of the U-shaped rear leg. In an embodiment, the front and/or rear legs are tubular, e.g., made of tubes such as tubular bars.

In some embodiments, positioner 6 includes first segment 51 and second segment 52 slidably coupled to each other. Each of first segment 51 and second segment 52 has first and second ends. The first end of first segment 51 is connected to the front leg, and the second end of second segment 52 is connected to the rear leg. In a preferred embodiment, the first end of first segment 51 is connected to the lateral segment of the front leg, and the second end of second segment 52 is connected to the lateral segment of the rear leg. Fastening device 6 is disposed at the first or second segment of the positioner, and configured to restrain the first and second segments from moving relative to each other, and thus stabilizes the foldable chair when the foldable chair is unfolded.

In an embodiment, first segment 51, second segment 52, or both are tubular, e.g., tubular bars. In an embodiment, second segment 52 or at least a portion of second segment 52, is smaller than first segment 51 and slidably inserted into first segment 51 of positioner 5.

In some embodiments, each of the first and second segments of positioner 5 is formed with at least one aperture such as aperture 521 illustrated in FIG. 3. As used herein, the term "aperture" refers to a hole, a cavity, a recess or the like. In embodiments where the first and second segments of the positioner are tubular, e.g., tubular bars, the aperture is formed on a wall of the tube. In some embodiments, the aperture of the first segment is formed adjacent the second end of the first segment. In some embodiments, the aperture of the second segment is formed adjacent the second end of the second segment.

Referring to FIG. 2, in some embodiments, fastening device 6 includes slider 61, push-button 62, elastic member 63, and pin 64. The slider is disposed at first segment 51 of the positioner, and is slidable with respect to second segment 52 of the positioner. In a preferred embodiment, the slider is fixedly coupled to the second end of the first segment, and is slidable with respect to the second segment. In another preferred embodiment, the slider is sleeved onto the second end of the first segment, and is slidable with respect to the second segment. The slider is formed with an aperture that allows pin 64 to pass through. In an embodiment, slider 61 includes or is formed with receiving chamber 611. In such embodiment, the aperture of the slider is formed at a wall of the receiving chamber, as illustrated in FIG. 2.

In exemplary embodiments, push-button 62 has first and second ends. The first end of the push-button is connected to the slider through the elastic member and the second of the push-button is connected to the pin. In an embodiment, the elastic member is a spring. In a preferred embodiment, the push-button and the elastic member are disposed in the receiving chamber of the slider.

Pin 64 has first and second ends, with the first end connected to the second end of the push-button, and the second end configured to be insertable into the apertures of slider 61, first segment 51 and second segment 52. In an embodiment, the pin has a length longer than a free length of the elastic member. The pin, when inserted into the apertures of slider 61, first segment 51 and second segment 52, couples the slider, the first segment and the second segment together, and prevents the first segment and the second segment from moving relative to each other. Accordingly, the length of the positioner is fixed, restraining the front and rear legs from moving toward or away from each other, and thus stabilizing the chair when in use.

Alternatively, in some embodiments, pin 64 can function as a fastening device without slider 61, push-button 62, and elastic member 63.

To fold the foldable chair, the first and second segments of the positioner are disengaged to allow the first and second segments to move relative to each other, and thus to adjust the length of the positioner. This can be accomplished by releasing the pin from the second segment of the positioner. In embodiments where the fastening device includes the push-button, pressing downward of the first end of the push-button releases the pin from the second segment, and in some cases, from the first segment and/or the slider as well. When the pin is released, the first or second or both segments are pulled to elongate the positioner. The elongation of the positioner pushes the lateral segments of the front and rear legs away from each other, resulting in folding of the foldable chair.

To unfold the foldable chair, the first and/or second segments are pushed toward each other (for example, by pushing the lateral segments of the front and rear legs toward each other) until the apertures of the first and second segments are aligned. Insert the pin into the apertures of the first and second segments to couple the first and second segments. In embodiments where the fastening device includes the push-button, the pin is pushed by the elastic member and inserted into the apertures of the slider, the first segment and the second segment. The pin, when inserted into the apertures, restrains the first segment and the second segment from moving relative to each other. As such, the length of the positioner is fixed at this state, the front and rear legs are restricted from moving toward or away from each other, and the foldable chair is stable and safer to use.

The foldable chair of the present invention has several advantages over the existing foldable chairs. For example, the foldable chair of the present invention is more stable and safer to use. In addition, the structure of the foldable chair of the present invention is relatively simple.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that, although the terms "first," "second," etc. may be used herein to describe various elements, these elements should not be limited by these terms. These terms are only used to distinguish one element from another. For example, a first segment could be termed a second segment, and, similarly, a second segment could be termed a first segment, without changing the meaning of the description, so long as all occurrences of the "first segment" are renamed consistently and all occurrences of the "second segment" are renamed consistently.

What is claimed is:

1. A foldable chair, comprising:

front and rear legs crossingly and pivotally connected to each other;

a seat frame supported by the front and rear legs and tilted when the foldable chair is unfolded; and a stabilizing mechanism restraining the front and rear legs from moving relative to each other when the foldable chair is unfolded or in use, thereby preventing undesired or inadvertent folding of the foldable chair, the stabilizing mechanism comprising:

a positioner connected to the front and rear legs, and having a length adjustable to facilitate folding and unfolding of the foldable chair, wherein the positioner comprises:

a first segment, formed with a first aperture, the first segment having first and second ends, the first end thereof connected to the front leg;

a second segment, formed with a second aperture, slidably coupled to the first segment, the second segment having first and second ends, the second end thereof connected to the rear leg, a fastening device configured to restrain the first and second segments from moving relative to each other, the fastening device comprising:

a slider disposed at the first segment or the second segment of the positioner, the slider comprising a third aperture;

a push-button comprising first and second ends;

an elastic member connecting the first end of the push-button with the slider; and a pin comprising first and second ends, the first end of the pin connected to the second end of the push-button, the second end of the pin configured to be insertable into the first, second and third aperture, wherein when the second end of the pin is inserted into the first, second and third apertures, the pin restrains the first segment and the second segment from moving relative to each other.

2. The foldable chair of claim 1, wherein the aperture of the second segment is formed adjacent the second end of the second segment.

3. The foldable chair of claim 1, wherein one or more of the first and second segments of the positioner are tubular.

4. The foldable chair of claim 1, wherein at least a portion of the second segment of the positioner is slidably inserted into the first segment of the positioner.

5. The foldable chair of claim 1, wherein the seat frame is round or circular.

6. The foldable chair of claim 1, wherein the slider comprises a receiving chamber, and wherein the push-button and the elastic member are disposed in the receiving chamber of the slider.

7. The foldable chair of claim 1, wherein the slider comprises a receiving chamber, and the aperture of the slider is formed at a wall of the receiving chamber.

8. The foldable chair of claim 1, wherein the slider is slidable with respect to the second segment.

9. The foldable chair of claim 1, wherein the slider is sleeved onto the second end of the first segment, and is slidable with respect to the second segment.

10. The foldable chair of claim 1, wherein the elastic member comprises a spring.

11. The foldable chair of claim 1, wherein the pin has a length longer than a free length of the elastic member.

12. The foldable chair of claim 1, wherein the aperture of the first segment is formed adjacent the second end of the first segment.

13. The foldable chair of claim 1, wherein:

the front leg is of a U-shape comprising two supporting segments and a lateral segment in between;

the rear leg is of a U-shape comprising two supporting segments and a lateral segment in between;

corresponding supporting segments of the U-shape front and rear legs are scissor-crossingly and pivotally connected to each other;

the first end of the first segment of the positioner is connected to the lateral segment of the front leg; and the second end of the second segment of the positioner is connected to the lateral segment of the rear leg.

14. The foldable chair of claim 13, wherein a first open end and a second open end of the U-shaped front leg are pivotally connected to the seat frame.

15. The foldable chair of claim 13, further comprising two links, each having one end pivotally connected to the seat frame and the other end pivotally connected to an open end of the U-shaped rear leg.

16. A foldable chair, comprising:

front and rear legs crossingly and pivotally connected to each other;

a seat frame supported by the front and rear legs and tilted when the foldable chair is unfolded; and a stabilizing mechanism restraining the front and rear legs from moving relative to each other when the foldable chair is unfolded or in use, thereby preventing undesired or inadvertent folding of the foldable chair, the stabilizing mechanism comprising:

a positioner connected to the front and rear legs, and having a length adjustable to facilitate folding and unfolding of the foldable chair; and a fastening device disposed at the positioner, and configured to prevent the positioner from inadvertently adjusting its length when the foldable chair is unfolded, wherein the positioner comprises:

a first segment having first and second ends, the first end thereof connected to the front leg; and a second segment slidably coupled to the first segment and having first and second ends, the second end thereof connected to the rear leg, and wherein the fastening device is disposed at the first or second segment, and configured to restrain the first and second segments from moving relative to each other, thereby stabilizing the foldable chair when the foldable chair is unfolded, and one or more of the first and second segments of the positioner are tubular.

17. The foldable chair of claim 16, wherein one or more of the first and second segments of the positioner are tubular.

18. The foldable chair of claim 16, wherein at least a portion of the second segment of the positioner is slidably inserted into the first segment of the positioner.

19. The foldable chair of claim 16, wherein the seat frame is round or circular.

* * * * *